United States Patent [19]

Steuernagel et al.

[11] Patent Number: 4,557,541

[45] Date of Patent: Dec. 10, 1985

[54] APPARATUS FOR CONNECTING CABLES TO PRINTED CIRCUIT BOARDS

[75] Inventors: Gernot Steuernagel, Offenbach; Willy Bohnenberger, Mainhausen, both of Fed. Rep. of Germany

[73] Assignee: Licentia Patent-Verwaltungs-GmbH, Frankfurt am Main, Fed. Rep. of Germany

[21] Appl. No.: 623,431

[22] Filed: Jun. 22, 1984

[30] Foreign Application Priority Data

Jun. 25, 1983 [DE] Fed. Rep. of Germany ..... 3323029

[51] Int. Cl.[4] ..... H01R 11/20; H01R 23/68; H01R 13/506

[52] U.S. Cl. ..... 339/17 LM; 339/91 R; 339/99 R; 339/132 B; 411/182

[58] Field of Search ..... 339/17 L, 17 LC, 17 LM, 339/17 M, 91 R, 99 R, 132 B; 361/415; 411/182, 508, 509, 510

[56] References Cited

U.S. PATENT DOCUMENTS

| | | | |
|---|---|---|---|
| 2,882,780 | 4/1959 | Edwards | 411/510 |
| 3,141,489 | 7/1964 | Rapata | 411/182 |
| 3,177,404 | 4/1965 | Patmore | 361/415 |
| 3,601,779 | 8/1971 | Waller, Sr. | 339/91 R |
| 3,766,550 | 10/1973 | Vandemore et al. | 361/415 |
| 3,966,290 | 6/1976 | Little et al. | 339/17 LC |
| 4,363,530 | 12/1982 | Verhoeven | 339/196 M |
| 4,431,248 | 2/1984 | Huntley et al. | 339/99 R |
| 4,448,471 | 5/1984 | Berry et al. | 339/91 R |
| 4,475,781 | 10/1984 | Asick et al. | 339/17 LM |

*Primary Examiner*—Neil Abrams
*Attorney, Agent, or Firm*—Spencer & Frank

[57] ABSTRACT

In order to connect cables to printed circuit boards disposed in an equipment housing, the back ends of the printed circuit boards are equipped with female multi-point connectors. The female multi-point connectors are inserted into male multi-point connectors which are fastened to the front side of a rear wall panel extending transversely to the printed wiring boards. The male multi-point connectors have straight pins which extend through holes in the rear wall panel and project beyond the back side of the rear wall panel. Guide frames for female multi-point connectors are mounted on the back side of the rear wall panel and surround rows of projecting pins. The female multi-point connectors are connected to cables and inserted into the guide frames, thereby electrically connecting the cables to the printed circuit boards. If desired, male multi-point connectors may be fastened to the front ends of the printed circuit boards, and these male multi-point connectors are enclosed by guide frames whose dimensions are matched to the dimensions of the front plates which would otherwise be attached to the printed circuit boards. The printed circuit boards can then be mounted within the equipment housing via the guide frames.

5 Claims, 2 Drawing Figures

APPARATUS FOR CONNECTING CABLES TO PRINTED CIRCUIT BOARDS

BACKGROUND OF THE INVENTION

The present invention relates to an apparatus for connecting cables with the terminals of printed circuit boards which have electronic devices mounted thereon and which are arranged parallel to one another in an equipment housing.

Printed circuit boards for electrical or electronic devices are frequently connected with a rear wall panel in electrical equipment. The rear wall panel may itself be a printed circuit board having conductor paths for connecting various terminals of the individual printed circuit boards without the use of wires. From the rear wall panel, wires or cables also lead to external units or appliances.

The rear wall panel may be of the multilayered type, having different layers of printed circuit conductor patterns that are insulated from one another, and may be provided with press-in pins which form contacts, as required, with metallized bores in the rear wall panel. The press-in pins project beyond the planes of both sides of the panel. On the side of the rear wall panel facing the printed circuit boards with the electronic devices, frames enclose parallel rows of plug-in pins which are spaced from one another at distances fixed for a plug-in connection. The frames serve as guides for female multi-point connectors which are connected with the printed circuit boards. On the side of the rear wall panel facing away from the printed circuit boards, spacers are arranged at the ends of the parallel rows of plug-in pins and further frames are fastened to these spacers so as to surround the ends of the press-in pins which project beyond the spacers. On the sections of the press-in pins extending between the rear wall panel and the underside of the frames, wire wrap connections may be provided. The frames form guides for socket elements which are plugged onto the ends of the plug-in pins.

In an arrangement as described above, the cost for connecting cables to printed circuit boards with electronic devices is relatively high. The frames provided for connection of the cable plugs can be used primarily in conjunction with press-in pins and rear wall panels only.

SUMMARY OF THE INVENTION

It is the object of the present invention to provide a device for connecting cables to printed circuit boards bearing electronic devices so that it is feasible, with the least possible expenditure, to connect cables to the front and/or rear ends of the printed circuit boards.

This is accomplished according to the present invention by providing female multi-point connectors attached to the back ends of printed circuit boards in order to provide connections with male multi-point connectors that are fastened to a rear panel wall which extends transverse to the printed circuit boards. The male multi-point connectors have rows of pins which extend through the holes in the rear panel wall. The rows of pins projecting from the rear panel wall opposite the printed circuit boards are surrounded by guide frames. Female multi-point connectors which are connected to cables are inserted into the guide frames to provide connections between the printed circuit boards and the cables. Additionally, male multi-point connectors can be fastened to the front ends of the printed circuit boards, the male multi-point connectors being surrounded by guide frames whose dimensions correspond to the dimensions of front plates by which printed circuit boards are mounted in an equipment housing. It is advantageous for the guide frames surrounding such male multi-point connectors at the front ends of the printed circuit board to be provided with elongated recesses which accommodate elastic elements and which are used to mount the printed circuit boards to transverse rails on the equipment housing.

The guide frames which are fastened on the side of the rear wall panel opposite the printed circuit boards act as empty housings for the female multi-point connectors. Thus, commercially available parts, which are used to a larger extent also to establish other types of connections, can be used to connect the printed circuit boards with the rear wall panel and the cable plugs. This results in a particularly economical solution. If the number of external terminals which can be accommodated at the back end of a printed circuit board is insufficient, the front end of the printed circuit board may also be provided with a male multi-point connector which, in conjunction with a guide frame, takes the place of the customary front panel. The guide frame is screwed to horizontal supporting rails. The guide frame, which encloses the male multi-point connector at the front end of the printed circuit board, is not as versatile a part as the components employed for connecting printed circuit boards with the rear wall panel or the cable plugs. Since only commercially available, low-cost male multi-point connectors and empty housings are required at the rear wall panel to provide for cable connections, it is advisable to equip the rear wall panel with such devices at all printed circuit board locations, even if not all printed circuit board locations in the device are initially occupied by printed circuit boards. The expenses resulting from equipping all printed circuit board locations with connecting elements are significantly less than the expenses required for subsequent expansion if additional printed circuit boards are later required at the available empty locations.

In a preferred embodiment, the female multi-point connectors inserted into the guide frames are designed to include a member which has cutting elements and which cooperates with a wire guide element for connecting the wires in a cut-clamp manner. It is advantageous to surround the member having cutting elements and the wire guide element with a pair of housing half-shells which snap together by detent connection. It is also advantageous for the half-shells to include lateral projections having recesses for accommodating locking hooks which lock the half-shells to the guide frame. The individual conductors of the circular conductor cables to be attached can be connected economically and quickly with the above-described cable plugs. It is then possible to connect incoming and outgoing lines by way of, for example, 64-position cable plugs.

DESCRIPTION OF THE PREFERRED EMBODIMENTS

Figure 1:
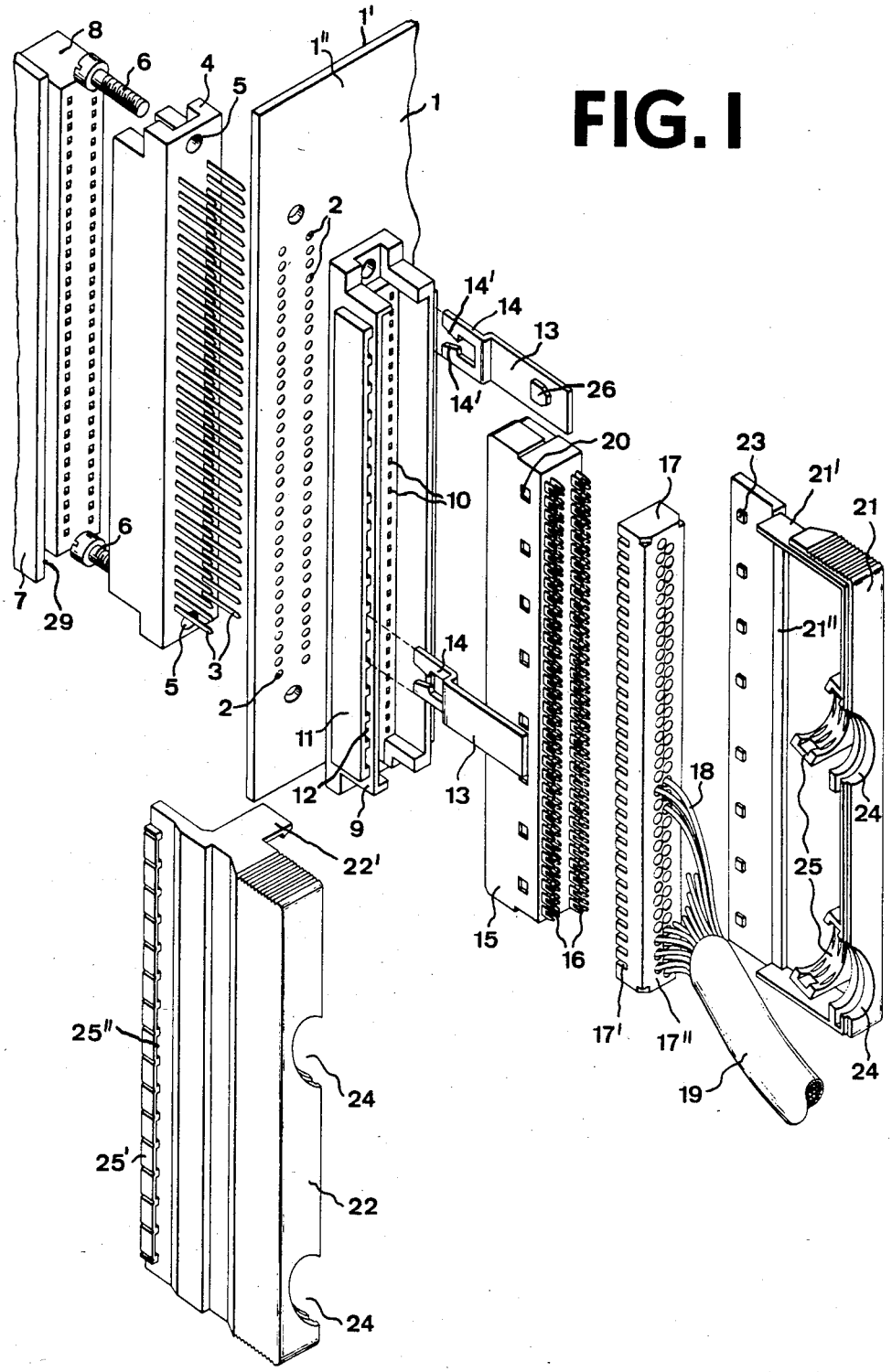
FIG. 1 is an exploded perspective view illustrating the rear wall panel of an equipment housing and an apparatus according to the invention for connecting a cable on one side of the rear wall panel to the back end of a printed circuit board on the other side.

In FIG. 1, rear wall panel 1 of an equipment housing has a first side 1' facing the interior of the housing and a second side 1" facing away from the interior. Panel 1 has parallel rows of holes 2 arranged at a given distance from one another. This distance corresponds to the separation between pins 3 in a male multi-point connector 4. Parallel rows of straight pins 3 extend through connector 4, one end of a pin 3 being shown individually in the drawing. At both ends of male multi-point connector 4, holes 5 are provided which extend parallel to pins 3. By means of screws 6 inserted into the holes 5, male multi-point connector 4 is fastened to rear wall panel 1. In the installed state, pins 3 project beyond the surface of side 1" of rear wall panel 1. Terminals (not illustrated) provided by conductor paths (not illustrated) on printed circuit board 7, which bears electrical or electronic devices (not illustrated), are electrically connected to male multi-point connector 4 by means of a female multi-point connector 8 which is fastened to the back end 29 of printed circuit board 7.

The ends of pins 3 projecting, in parallel rows, beyond the surface of side 1" of rear wall panel 1 are surrounded by a guide frame 9 for accommodating a female multi-point connector. Guide frame 9 is provided with holes 10 through which pins 3 project. Screws 6 and nuts (not illustrated) fasten guide frame 9 to rear wall panel 1. At its sides guide frame 9 is equipped with elongate projections 11 provided with recesses 12 into which the fork-shaped ends 14 of locking hooks 13 can be inserted. Guide frame 9, with the ends of pins 3 projecting beyond holes 10, is combined with a female multi-point connector 15 equipped with conductive cutting elements 16 which are provided for the connection of wires in the cut-clamp technique. That is, during use insulated wires are clamped against corresponding cutting elements 16, which pierce the insulation and bite into the wire within. A wire guide element 17 is fastened to female multi-point connector 15 and is equipped with channels 17' which position the insulated wires so that they will engage the corresponding cutting elements 16 when connector 15 and element 17 are pressed together. The cutting elements 16 protrude into the channels 17' engaging also the walls of the channels 17' for clamping the connector 15 to the element 17. The free ends of wires 18 of a cable 19 are inserted into the channels; the cable may lead to external units or devices. At its longitudinal sides, female multi-point connector 15 is provided with recesses 20. Two cable housing half-shells 21 and 22 are provided with projections 23 which engage recesses 20 when cable housing half-shells 21 and 22 are placed next to one another around female multi-point connector 15 and wire guide element 17.

Flexible detent elements 22' extending from half-shell 22 engage shoulders 21' of half-shell 21, producing a firm snap-together connection between housing half-shells 21 and 22 when the half-shells are pressed together after female multi-point connector 15 and wire guide element 17 are positioned between them. In the resulting assembly connector 15 and element 17 are sandwitched between half-shells 21 and 22, with projections 23 extending into recesses 20 to secure connector 15 and with flange 21" of half-shell 21 and a corresponding flange (not visible in FIG. 1) of half-shell 22 engaging top side 17" of element 17 to clamp element 17 against connector 15. Recesses 24 for the passage of cables 19 are provided in housing half-shells 21 and 22. Moreover, clamping elements 25 for cables 19 are also provided in housing half-shells 21 and 22.

A number of male multi-point connectors 4 and guide frames 9 corresponding to the number of printed circuit board locations are fastened parallel to one another to rear wall panel 1. For reasons of clarity, these parts are shown only once in FIG. 1. If required, printed circuit boards 7 are inserted into the corresponding locations. If desired connections can be established between the pins 3 of various male multi-point connectors 4 by connecting selected holes 2 with conductive paths provided on rear wall panel 1. If required, a multilayer plate can be used as the rear wall panel.

Housing half-shells 21 and 22 are provided with lateral projections 25' which are equipped with recesses 25" for accommodating the locking hooks 13. At the ends of locking hooks 13 there are provided detent tongues 26 which engage in recesses of housing half-shells 21 and 22. After half-shells 21 and 22 are snapped together around connector 15 and element 17, fork-shaped ends 14 are inserted into the recesses 12 of frame 9. The fork-shaped ends 14 of locking hooks 13 are slightly flexible and are provided with detents 14' which serve to affix hooks 13 to frame 9, so that connector 15 is firmly secured. Preferably at least two locking hooks 13 are provided at each side of frame 9. Male multi-point connector 4 and the guide frame 9 are commercially available, inexpensive, multi-purpose components. Therefore the device for connecting the cables to the printed circuit boards 7 can be produced economically.

Figure 2:
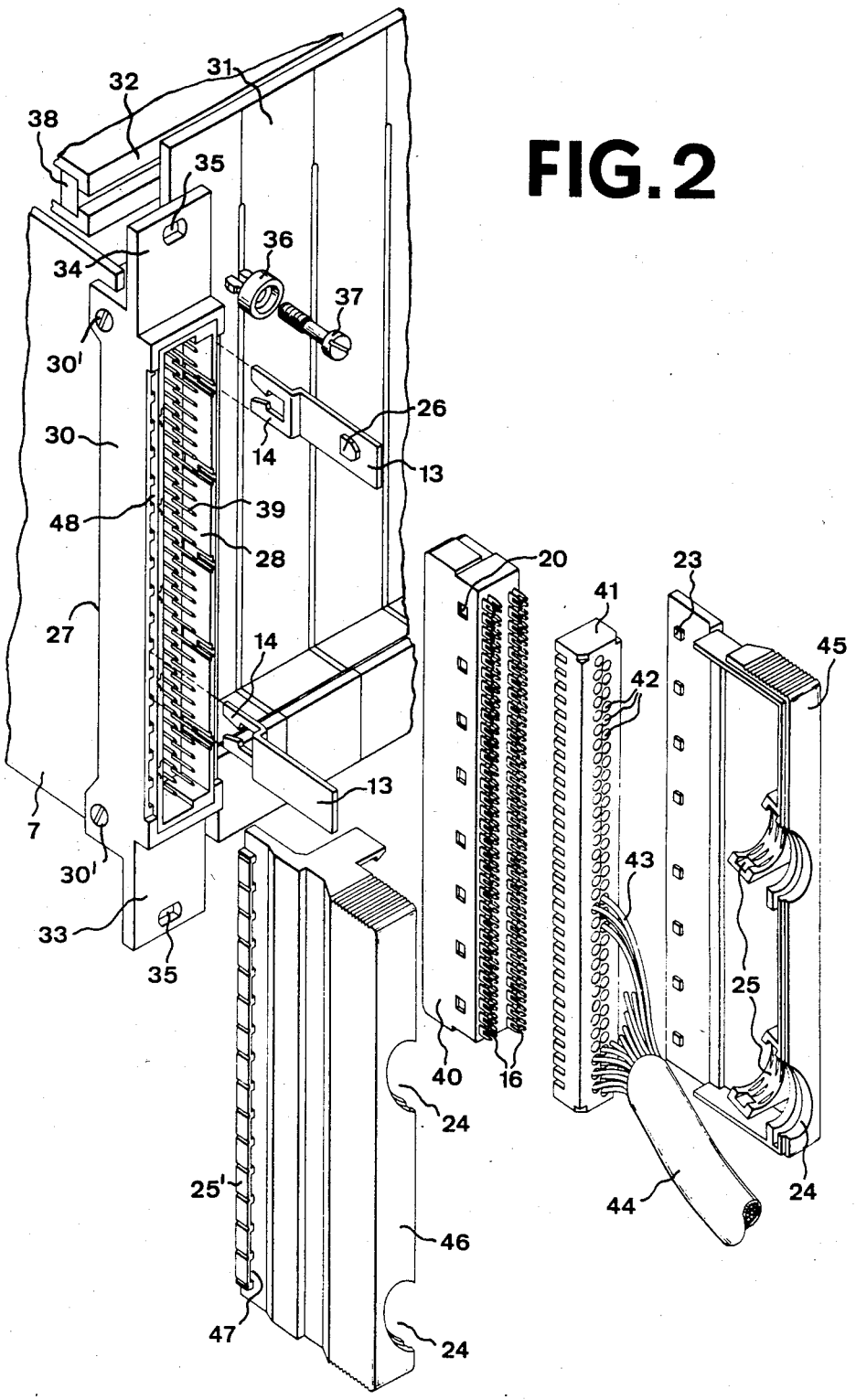
FIG. 2 is an exploded perspective view illustrating an apparatus according to the invention for connecting a cable to the front end of a printed circuit board in an equipment housing.

Referring next to FIG. 2, male multi-point connectors 28 may be fastened to front end 27 of printed circuit board 7 if the number of terminals available at back end 29 is insufficient. Male multi-point connector 28 is surrounded by and mounted in guide frame 30, which in turn is attached to board 7 by screws 30'. The length and width of frame 30 match the length and width of front plates 31 attached at the ends of printed circuit boards and fastened to rails 32 provided on the equipment housing. At ends 33 and 34, guide frame 30 is provided with recesses 35 for accommodating inserts with which it is screwed to rails 32. This fastening may be effected by means of screws and threaded strips which are inserted into grooves (not identified in detail) in rail 32. Preferably, recesses 35 are elongated and serve to accommodate an elastic intermediate member 36 which is connected with threaded strip 38 by means of screws 37. Pins 39 of connector 28 engage in elements of a female multi-point connector 40 connected with male multi-point connector 28. The configuration of female multi-point connector 40 corresponds to that of female multi-point connector 15. Therefore, the same elements of female multi-point connectors 15 and 40 have been given the same reference numerals.

A wire guide element 41 corresponding in design to wire guide element 17 is placed onto female multi-point connector 40. Wire guide element 41 is provided with channels into which the free ends of wires 43 are inserted. Wires 43 extend to locations at which they are connected, in the cut-clamp technique, with cutting elements 16. The wires belong to a cable 44 which leads to external units or to other connecting points on the front or rear of printed wiring boards 7. Female multi-point connector 40 and wire guide element 41 are secured within two housing half-shells 45 and 46 when the latter are in their closed state. Housing half-shells 45 and 46 coincide in structure with housing half-shells 21 and 22. Locking hooks 13 can be inserted into recesses 47 in lateral projections 25' extending from housing half-shells 45 and 46, and the fork-shaped ends of these locking hooks engage in recesses 48 in guide frame 30.

The washer-type intermediate members 36 are provided with two tabs spaced apart. The tabs are provided with detents which serve to affix the intermediate members 36 to the ends 33 and 34 of guide frame 30. The screws 37 have undersized bodies which are inserted in the intermediate members 36 before the tabs are put into the recesses 36. By the intermediate members 36 the screws 37 are undetachably connected to the ends 33 and 34.

It will be understood that the above description of the present invention is susceptible to various modifications, changes and adaptations, and the same are intended to be comprehended within the meaning and range of equivalents of the appended claims.

What we claim is:

1. An apparatus for electrically connecting a cable including insulated wires to terminals on a first printed circuit board which bears electronic devices and which is disposed in an equipment housing having front and rear sides, said first printed circuit board having a rear end directed toward the rear side and a front end directed toward the front side, with a plurality of second printed circuit boards being disposed in said housing parallel to said first printed circuit board, at least one second printed circuit board being affixed to a front plate for mounting said at least one second printed circuit board, comprising:

a first female multi-point connector attached to said first printed circuit board adjacent the rear end thereof, said female multi-point connector being electronically connected to the terminals on said first printed circuit board;

a rear wall panel extending transversely to said printed circuit board and closing the rear side of the equipment housing, said rear wall panel having first and second sides and having rows of holes therein, said first printed circuit board being disposed at the first side of said rear wall panel;

a male multi-point connector affixed to the first side of said rear wall panel, said male multi-point connector having pins which are insertable into said female multi-point connector and which extend through the holes past the second side of said rear wall panel;

a guide frame mounted on the second side of said rear wall panel and surrounding said pins;

multi-point connectors means for attachment to the cable, the multi-point connector means being insertable into the guide frame to electrically connect the cable to the first printed board terminals, said multi-point connector means including a second female multi-point connector having conductive cutting elements to electrically connect the wires by piercing the insulation of the wires when the wires are clamped against the cutting elements, a wire distribution element holding the wires against said cutting elements, two housing half-shells surrounding the second female multi-point connector and the wire distribution element, and detent means provided on said housing half-shells for holding said half-shells together;

an additional male multi-point connector fastened to said front end of said first printed circuit board and electrically connected to terminals on said first printed circuit board; and an additional guide frame surrounding said additional male multi-point connector, said additional male multi-point connector having a length and width substantially matching the length and width of said front plate.

2. The apparatus of claim 1, further comprising a lateral projection extending from a housing half-shell, said lateral projection having recesses therein, and locking hook means inserted into the recesses and connected to said guide frame for locking said multi-point connector means to said guide frame.

3. The apparatus of claim 1, wherein said equipment housing additionally has rails disposed at the front side of the housing and extending transverse to said first printed circuit board, said front plate being mounted on said transverse rails, wherein said additional guide frame has elongated recesses therein, and further comprising elastic elements inserted into the recesses and means cooperating with the elastic elements for mounting said additional guide frame and first printed circuit board to said transverse rails.

4. The apparatus of claim 1, wherein said cable has a cross-section that is substantially round, wherein said conductive cutting elements of said second female multi-point connector are disposed in first and second rows that are spaced apart, and wherein said wire distribution element is an elongated member having first and second sides and first and second edges between said sides, said first side of said wire distribution element having at least one centrally disposed row of holes to convey wires from said first side to said second side, and said second side of said wire distribution element having a plurality of channels communicating with said first edge to guide wires to said first row of conductive cutting elements and a plurality of channels communicating with said second edge to guide wires to said second row of conductive cutting elements.

5. The apparatus of claim 1, wherein said second female multi-point connector has a top side from which said conductive cutting elements project and has edges between which said top side is disposed, said edges having recesses therein, wherein said housing half-shells have projections which extend into said recess to secure said second female multi-point connector when said detent means holds said half-shells together, wherein said wire distribution element is an elongated member having a top side and a bottom side, said bottom side facing the top side of said second female multi-point connector, and wherein said housing half-shells additionally have shoulders to engage the top side of said wire distribution element to retain said wire distribution element against the top side of said second female multi-point connector when said detent means holds said housing half-shells together.

* * * * *